United States Patent [19]

Goto et al.

[11] Patent Number: 4,819,931

[45] Date of Patent: Apr. 11, 1989

[54] SORTING APPARATUS

[75] Inventors: Chikado Goto; Hiroshi Tobita, both of Ibaraki, Japan

[73] Assignee: Ikegami Tsushinki Co., Ltd., Tokyo, Japan

[21] Appl. No.: 41,699

[22] Filed: Apr. 21, 1987

[30] Foreign Application Priority Data

| | | | |
|---|---|---|---|
| Sep. 9, 1986 | [JP] | Japan | 61-210677 |
| Sep. 9, 1986 | [JP] | Japan | 61-210678 |
| Sep. 9, 1986 | [JP] | Japan | 61-210679 |
| Sep. 9, 1986 | [JP] | Japan | 61-210680 |
| Sep. 9, 1986 | [JP] | Japan | 61-137366[U] |

[51] Int. Cl.[4] ..... B65H 39/10

[52] U.S. Cl. ..... 271/287; 271/297; 271/299; 271/300; 271/305

[58] Field of Search ..... 271/303, 305, 297, 287, 271/288, 289, 291, 298, 299, 300, 307, 186, 69

[56] References Cited

U.S. PATENT DOCUMENTS

| | | | |
|---|---|---|---|
| 3,523,603 | 8/1970 | Philips et al. | 271/69 X |
| 3,586,311 | 6/1971 | Schulze | 271/298 X |
| 3,765,670 | 10/1973 | Johnson | 270/58 |
| 4,299,382 | 11/1981 | Ichikawa | 271/297 X |
| 4,352,490 | 10/1982 | Hatakeyama | 271/303 X |
| 4,494,748 | 1/1985 | Miyashita et al. | 271/297 X |
| 4,555,106 | 11/1985 | Ruenzi | 271/297 |
| 4,649,840 | 3/1987 | Keeton | 271/70 X |

FOREIGN PATENT DOCUMENTS

| | | | |
|---|---|---|---|
| 2939941 | 4/1980 | Fed. Rep. of Germany . | |
| 89557 | 5/1983 | Japan | 271/287 |
| 627688 | 1/1982 | Switzerland . | |
| 658236 | 10/1986 | Switzerland . | |
| 1483469 | 8/1977 | United Kingdom . | |
| 2171396 | 8/1986 | United Kingdom | 271/307 |

*Primary Examiner*—Joseph J. Rolla
*Assistant Examiner*—David H. Bollinger
*Attorney, Agent, or Firm*—Parkhurst, Oliff & Berridge

[57] ABSTRACT

A compact sorting machine inverts recorded sheets into a face-down attitude and discharges them into individual trays. When a recorded sheet is sent from a feed opening, this sheet is transported on a transport path located below entrances of a plurality of trays. Guide members disposed in the vicinity of each tray entrance are driven according to a control signal so that the recorded sheet is discharged into individual trays. At this time, a guide member having an arc-shape simultaneously inverts the recorded sheet into a face-down attitude.

10 Claims, 11 Drawing Sheets

SORTING APPARATUS

BACKGROUND OF THE INVENTION

1. Field of the Invention

The present invention relates to a sorting apparatus, and more particularly to a compact sorting apparatus that can invert a recorded sheet to a face-down attitude allowing for discharge to one of a plurality of trays.

2. Description of the Prior Art

An example of a conventional sorting apparatus, a sorting apparatus used widely as a post-processing apparatus for recorded sheets in a photocopier. A plurality of trays for sorting and housing recorded sheets is generally arranged in a plurality of levels in a vertical direction and each recorded sheet is successively discharged to those trays by means such as moving either paper discharge openings at each tray entry or a single sheet discharge opening together with the upward and downward movement of a tray itself toward a tray entry formed between trays.

A conventional sorting apparatus, however, has been arranged so that the trays maintain a predetermined interval in a vertical direction in a fixed stacked condition, and each of the trays is supported in an inclined, protruding position in the discharge direction of the recorded sheet, so that a large overall size and height was unavoidable. Furthermore, when the recorded sheets were housed in the trays, an order in which they were stacked was in the opposite page order of an original document, thereby producing the inconvenience of having to restack the recorded sheets in order to sort a recorded document having a plurality of pages.

With the more widespread use of medium-sized photocopiers in recent years, it has become desirable to develop a sorting apparatus for this type of photocopier which is compact, and which offers greater ease of use to an operator.

SUMMARY OF THE INVENTION

It is, therefore, an object of the present invention to provide a compact and easy-to-use sorting apparatus in which individual trays are arrayed standing in a substantially vertical direction with respect to an inclined transport path, so that recorded sheets are inverted to a face-down attitude and housed in the trays in that attitude.

It is another object of the present invention to provide a compact, easy-to-use sorting apparatus by driving the individual means through a common drive shaft for feeding the recorded sheet to the apparatus to discharging the sheet to a tray.

It is another object of the present invention to provide a compact, easy-to-use sorting apparatus in which a plurality of trays are arrayed along a transporting means and in which recorded sheets can be successively and selectively discharged by a discharging roller and a guide member disposed on each tray.

It is a further object of the present invention to provide a particularly suitable transport means which can be used with apparatuses which do not demand a restricted transporting attitude.

It is a still further object of the present invention to provide a sorting apparatus on which the incidence of jamming is low, and on which a jam can be cleared easily should one occur.

A first aspect of the present invention relates to a sorting apparatus, in which recorded sheets guided from a feed opening or entry between an upper and a lower guide plates an individually fed to a transport path by feeding means and can be successively and selectively discharged into one of a plurality of fixed trays supported by a tray support member disposed along the transport path having an incline with a rising gradient with respect to a transport direction. The sorting apparatus has a plurality of fixed trays supported in a substantially standing position leaning to an opposite side of the rising gradient, and means for inverting the recorded sheet to a face-down attitude when discharging sheets successively and selectively to one of the plurality of fixed trays from the transport path.

In a sorting apparatus according to the above, when a recorded sheet is inserted to the feed opening, a motor starts to drive it along the transport path having an incline with a rising gradient. On the other hand, on the tray into which the recorded sheet is to be discharged, a tray selecting means is driven by the motor through a clutch mechanism so that guide members with pinch rollers are lowered to pick up the recorded sheet from the transport path. The recorded sheet is sandwiched between discharge rollers fitted to the tray along the guide member to invert the recorded sheet to a face-down attitude by the pinch rollers, and is discharged into the tray while being inverted into a face-down attitude in this condition.

In a second aspect of the present invention, each of the fixed trays has discharge rollers. There is a common drive shaft for driving a plurality of discharge rollers, a feeding means and a transporting means simultaneously. Also provided is a drive source for that shaft.

In an arrangement according to the above second aspect of the present invention, when the recorded sheet is inserted to the feed entry, the motor that is the drive source activates and the belt that is the means for rotating the feeding means and the transporting means through the common drive shaft at once with the discharge roller shafts can be rotated simultaneously so that the overall arrangement is compact, and the feeding means and the transporting means and the discharge roller drive means can be arranged swingably as individual units around the center of the common drive shaft.

In a third aspect of the present invention, discharge rollers disposed on each of a plurality of fixed trays are linked to a transporting means, and guide members having pinch rollers that can contact the discharge rollers and an electrical discharge means and formed into an arc shape along the contour of the discharge rollers and being supported in a circularly movable manner around the shaft of the discharge rollers are disposed on each fixed tray. Furthermore, only on the fixed tray selected by the tray selecting means is the guide member moved circularly to a position where it is possible to lead a recorded sheet from the transporting means to between the discharge rollers and the pinch rollers, and the guide member on fixed trays not selected can be supported in a position withdrawn from the transporting means.

In an arrangement according to the above third aspect of the present invention, when the recorded sheet is inserted to the feed entry, the feeding means and the transporting means and the discharge rollers disposed on the individual fixed trays are driven all at once, and when the fixed tray into which the recorded sheet is to be discharged is selected, the guide member disposed on that fixed tray is moved circularly around the discharge roller shaft, so that the recorded sheet is picked up from the transporting means and supported in that condition. The recorded sheet that has been transported is guided between the guide member and the discharge rollers, and is furthermore sandwiched by the pinch rollers, then deelectrified by the deelectrifying or destaticizing brush before being discharged into that fixed tray.

In a fourth aspect of the present invention, an arrangement having guide members formed in a circular shape along a curve of each discharge roller disposed on a plurality of trays and supported so as to be movable circularly around a roller shaft, and a transfer belt linked to a transporting means and that can transfer in an arrayed direction of the fixed trays, and a belt drive control means that can advance the transfer belt corresponding to the intervals between the arrayed fixed trays, and a tray selecting means having a movable cam attached to the transfer belt, when selecting a discharge tray the movable cam is advanced by the belt drive control means, the guide members are moved circularly by the movable cam and the recorded sheet is picked up between the discharge roller and the guide member from the transport means by the guide member so that it is discharged.

In an arrangement according to the above fourth aspect of the present invention, when the recorded sheet is transported by the transport means, on the fixed tray selected by the tray selecting means, the guide member disposed around the discharge roller for that tray allows the recorded sheet to be picked up by the guide member so that it is discharged to the tray by the discharge roller. The selection of the tray at this time is performed by an action in which an advance, due to the belt drive control means, of the transfer belt linked to the transport means engages the movable cam disposed on the transfer belt with the guide member of the selected tray so that the guide member moves circularly. Linking the transfer belt with the transport means eliminates the need for disposing a special drive source and allows for a compact arrangement in which all control actions up to discharge of the fed recorded sheet can be performed using the same drive source as for the transport means.

In a fifth aspect of the present invention, the transport path along which the recorded sheet is transported is formed by stretching a transport belt and a plurality of fine wires in the transporting direction over a surface of the transport belt and/or over the common contact surface of a series of transport pulleys, so that the plurality of fine wires supports the sheet body during transporting.

This arrangement provides the transporting force for the recorded sheet through the transport belt and/or the transport pulleys. In sorting apparatuses to which the present invention is applied wherein the transport path has a rising gradient that is not steep or is of the regular flat type, however, there is no need to provide a transporting force across the whole width of the recorded sheet body, so that in the above arrangement if the sheet body to which the transporting force is applied is formed from a material that slides easily and it is supported by stretched fine wires, there is no need to consider the friction during that interval, and transporting can be achieved by sliding along the fine wires.

The above and other objects, effects, features and advantages of the present invention will become more apparent from the following description of preferred embodiments thereof taken in conjuction with the accompanying drawings.

DETAILED DESCRIPTION OF PREFERRED EMBODIMENTS

An embodiment of the present invention is described in detail below with reference to the drawings.

First, in order to make the explanation more easily understood, the overall apparatus will be explained below by division into the four major arrangements of (1) a transport portion including a transport means having a transport path and a drive circuit for that transport means, (2) a tray support portion supporting a plurality of individual trays, (3) a feed means for guiding a recorded sheet from a feed entry that constitutes a feed portion, and (4) a control portion which controls a tray selecting means driven by a drive source of the transport portion.

Figure 1:
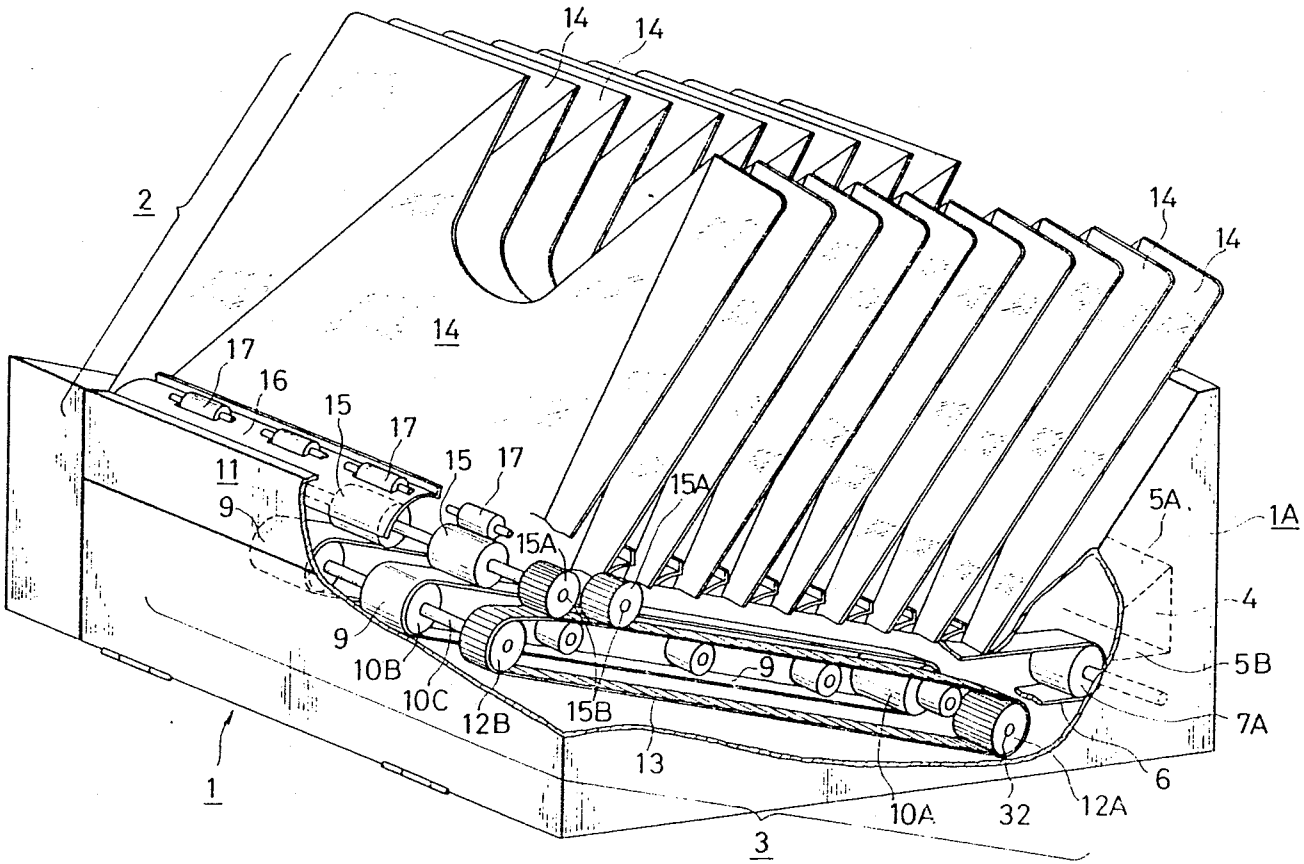
FIG. 1 is a perspective view showing a partial cross-section of a sorting apparatus according to the present invention.
Figure 2:
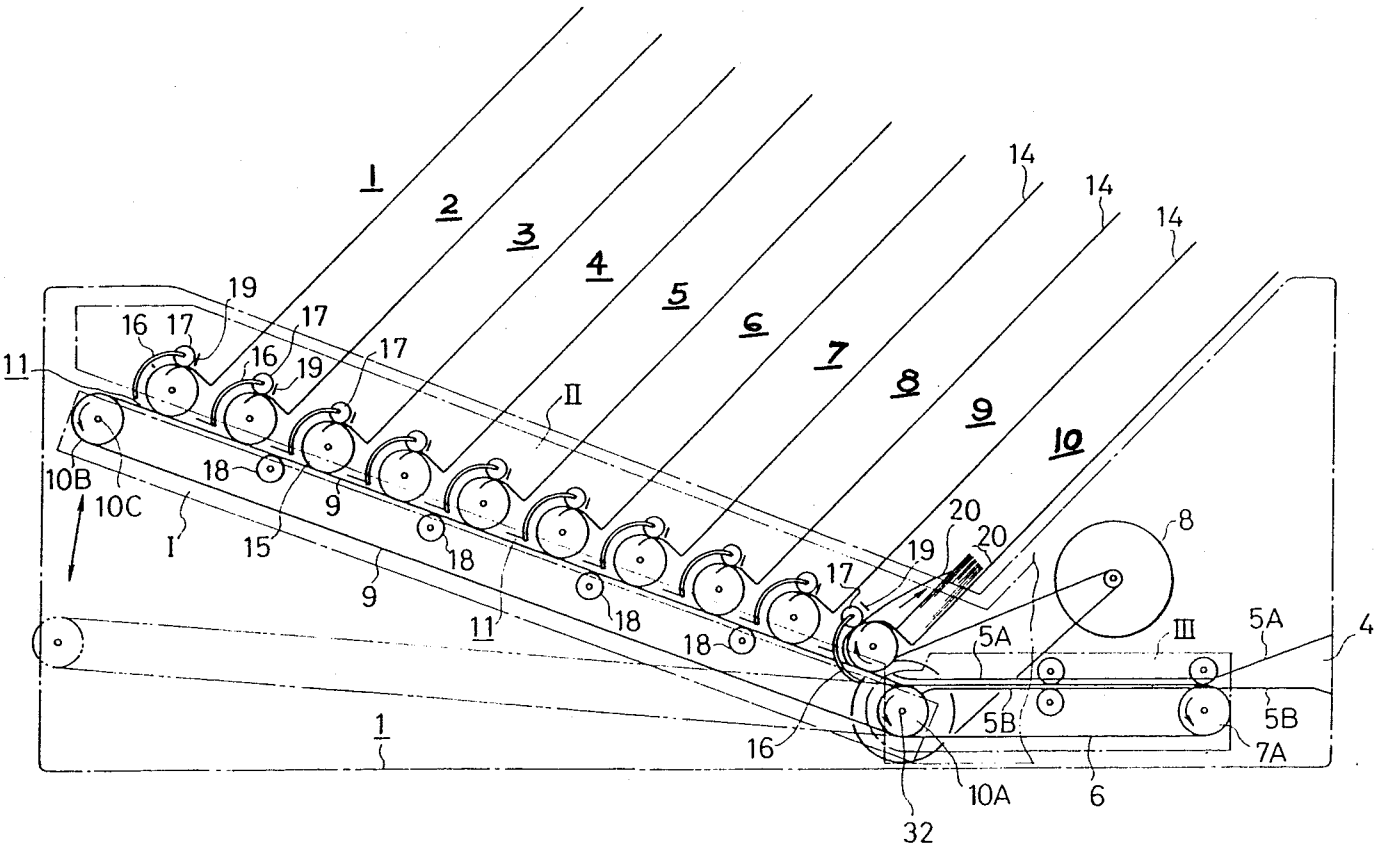
FIG. 2 is a schematic side view explaining the mutual relationships between a feed and a transport portion and a tray support in a sorting apparatus according to the present invention.

FIG. 1 shows a first embodiment of the present invention. In FIG. 1, reference numeral 1 denotes an external case, reference numeral 2 a tray support and reference numeral 3 a transport portion. A control portion not shown is housed on a side portion 1A inside the case 1. Reference numeral 4 denotes a recorded sheet feed entry and is aligned with a discharge opening of a photocopier or similar apparatus. Reference numeral 5A denotes an upper guide plate of the recorded sheet feed entry 4, reference numeral 5B a lower guide plate, and reference numerals 6 and 7A a feed belt and pulley disposed along the lower guide plate 5B. Furthermore, as shown in FIG. 2, a transport belt 9 is driven by a motor 8 simultaneously and at the same speed as the feed belt 6, and a transport pulley or feed-in roller 10A and a follow pulley or feed-out roller 10B are disposed in a transport portion 3. These transport means form a transport path 11 that guides a recorded sheet on an upper surface of the transport belt 9.

Furthermore, in FIG. 1 reference numerals 12A and 12B denote a drive sprocket and a follow sprocket disposed respectively on the same shafts as the transport pulley 10A and the follow pulley 10B. A chain belt 13 is stretched between these sprockets 12A and 12B. In this manner, this chain belt 13 can link the discharge rollers 15 disposed on each of the plurality of trays 14 supported on the side of the tray support 2. That is, reference numeral 15A denotes sprockets disposed on one edge of shafts 15B of the discharge rollers 15. These sprockets 15A are arranged so as to engage with the chain belt 13 from above, so that when the motor 8 drives, the discharge rollers 15 rotate all at once in a direction of an arrow through the chain belt 13 together with the above-mentioned feed belt 6 and the transport belt 9, thereby completing preparations to receive the recorded sheet.

Furthermore, a shaft 32 of the transport pulley 10A and a support shaft 10C of the follow pulley 10B across which is stretched the transport belt 9 are supported by a frame I as shown by a dotted-and-dash line in FIG. 2. A plurality of guide rollers 18 similarly supported by the frame I are disposed underneath the transport belt 9 (refer to FIG. 2).

Reference numeral 16 denotes guide members freely movable circularly around the discharge roller or tray shaft 15B and disposed on each of the trays 14. Reference numeral 17 denotes a pinch roller pivoted on the guide member 16. FIG. 2 shows this arrangement in further detail. In FIG. 2, reference numeral 19 denotes an deelectrifying or destaticizing brush mounted on the guide member 16. FIG. 2 shows the situation in which a recorded sheet 20 is discharged into the No. 10 bin which is at the front of the plurality of trays 14, 14, . . . which form 10 bins. The guide member 16 on this tray 14 is being pulled down so as to cut across the transport path 11. That is, the front edge of the recorded sheet collides with the guide member 16 and is guided along the arc-shaped surface of this guide member 16 so that the recorded sheet is inverted into a face-down position.

Figure 3:
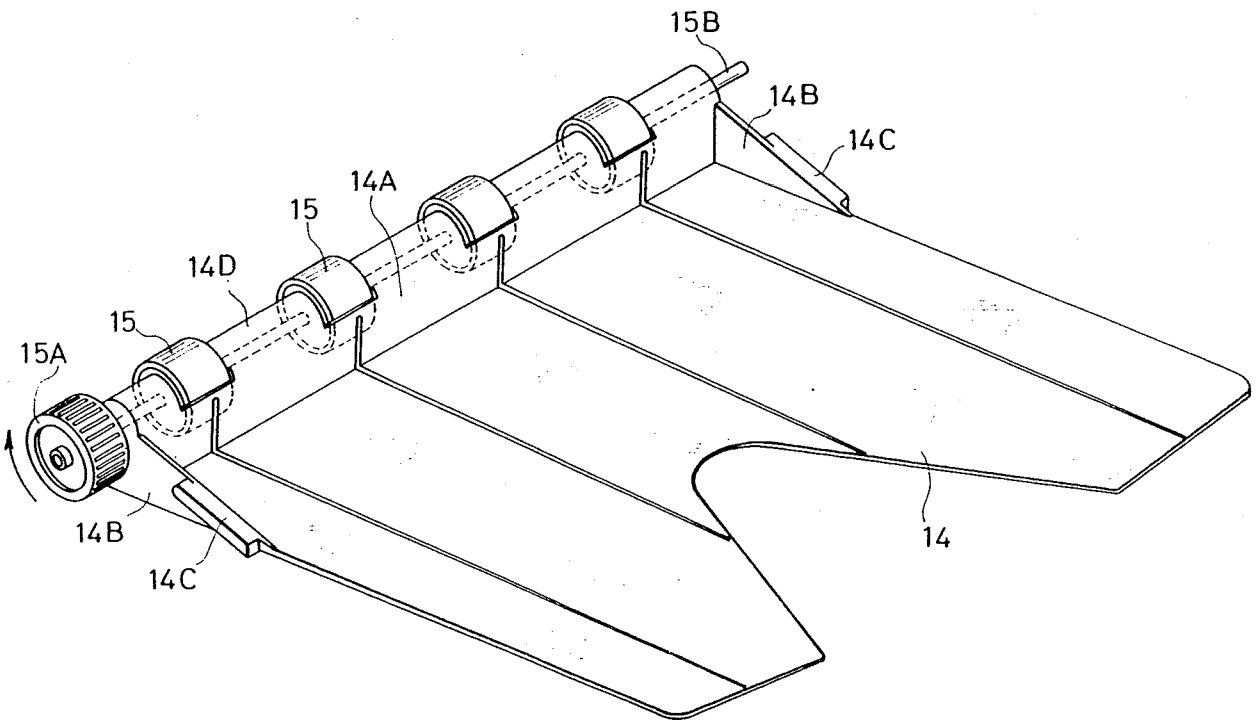
FIG. 3 is a perspective view showing a tray in a sorting apparatus according to the present invention.
Figure 4:
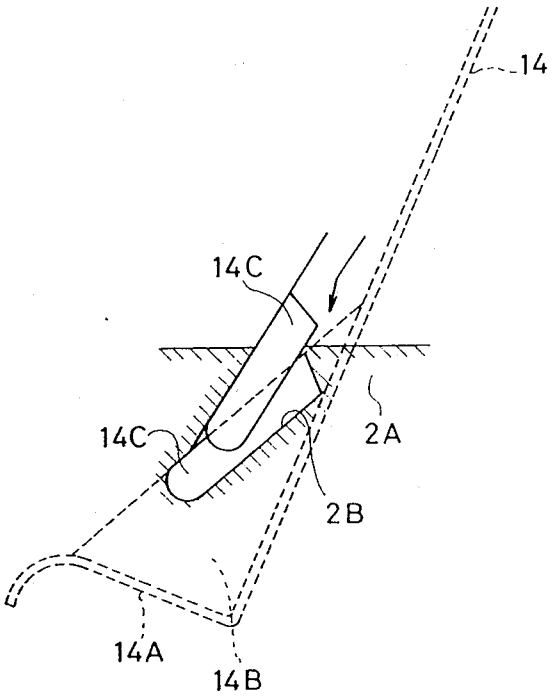
FIG. 4 is a schematic view explaining the operation when the above-mentioned tray is fixed.
Figure 5A:
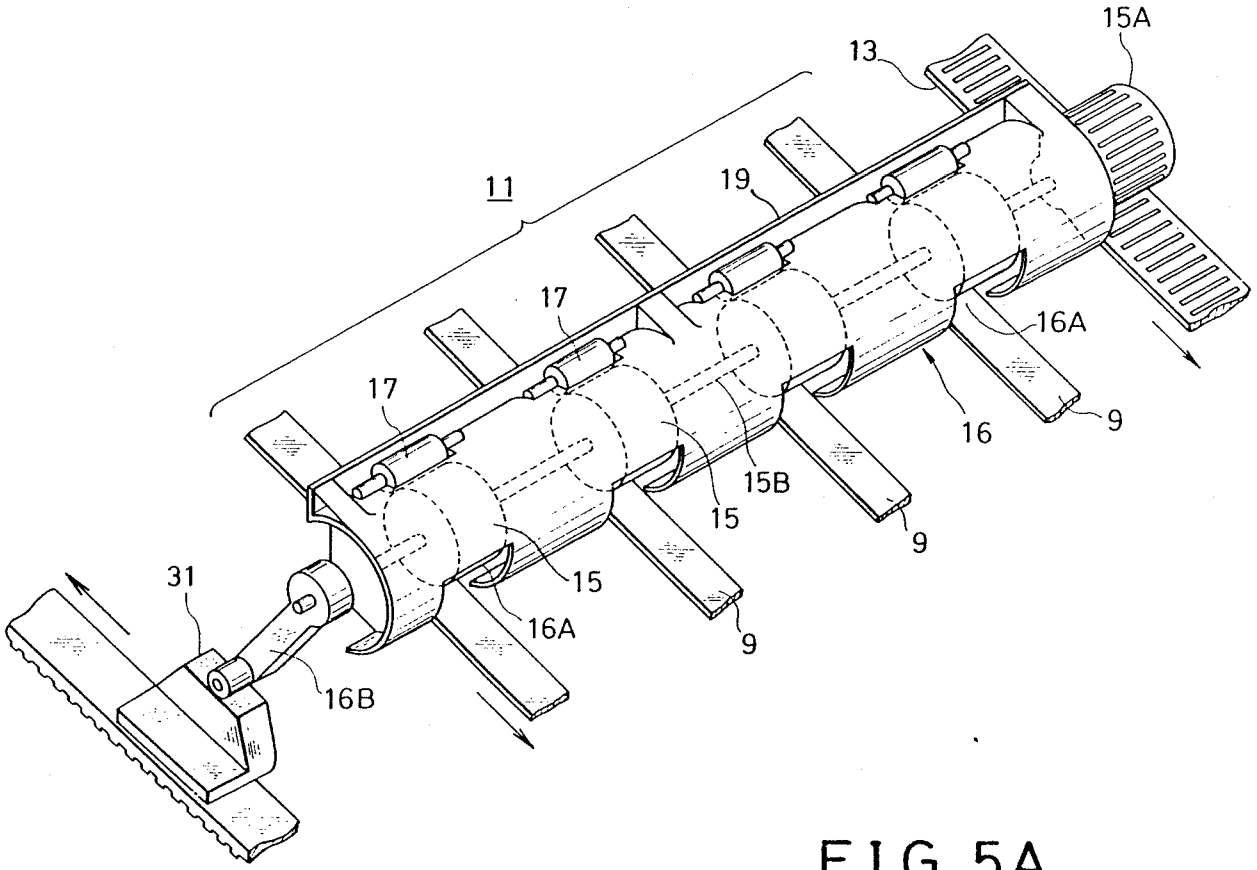
FIG. 5A is a perspective view showing a guide member disposed in a vicinity of a base edge of the above-mentioned tray.

FIG. 3 shows an arrangement of a tray. The tray 14 has on its entry side, that is its base edge, a flange 14A for housing a recorded sheet and triangular side walls 14B coupled to both sides of the flange 14A. These side walls 14B are arranged so as to pivotally support the discharge roller shaft 15B. Furthermore, as shown in FIG. 4, in a portion of the side walls 14B is formed a protruding arm 14C which is engagable with a fixing groove 2B on a tray support member 2A that is a part of a frame II shown by a dotted-and-dash line in FIG. 2. A cover 14D formed by bending a front edge portion of the flange 14A on the tray 14 into an inverted U-shape is disposed around the discharge roller shaft 15B. In this manner, each of the trays 14 is fixed by inserting the protruding arm 14C into the fixing groove 2B of the tray support member 2A. When the tray 14 is fixed by engaging the protruding arm 14C in the fixing groove 2B, as can be seen clearly in FIG. 2 each of the trays 14 is inclined substantially at 45° and are arrayed in a standing-up attitude. Consequently, when the recorded sheets are housed, the flange 14A aligns their edges uniformly. Furthermore, as shown in FIGS. 5A and 5B, the guide member 16 is supported pivotally on this discharge roller shaft 15B.

Figure 5B:
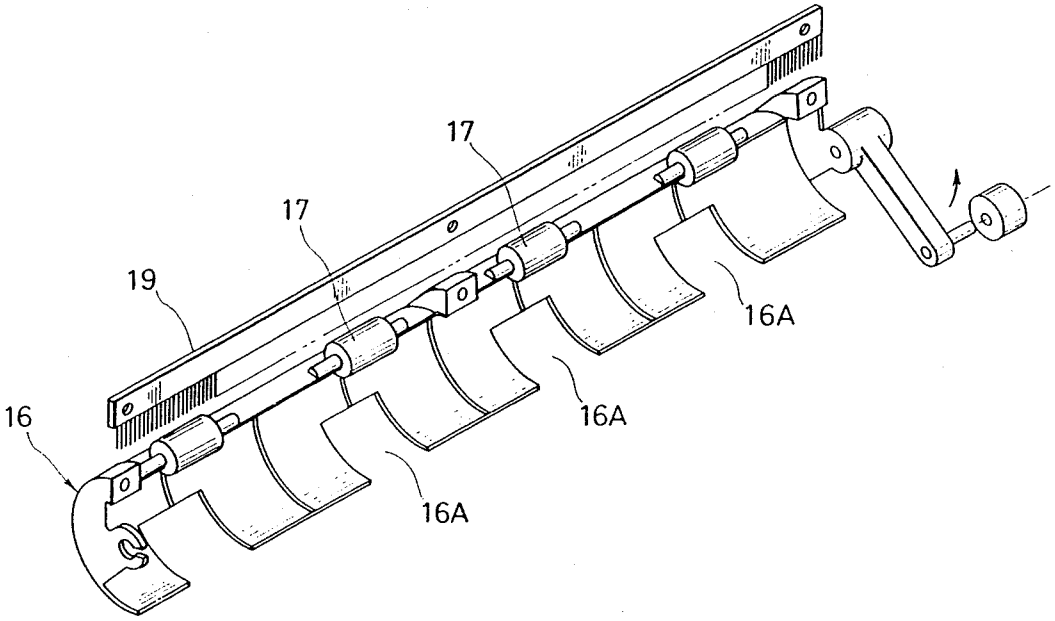
FIG. 5B is a perspective view showing the back surface of the guide member shown in FIG. 5A.

FIG. 5B shows a view of the guide member 16 from the side of the roller shaft 15B. Notches 16A are formed in the guide member 16 which has a substantially arc-shaped cross-section in positions corresponding to the transport belts 9. Furthermore, a circularly movable arm 16B to whose front edge is attached a roller 16C that is a cam follower is disposed in one of pivotal support portions 16D formed on both ends of the guide member 16 and in which the discharge roller shaft 15 is supported. The circular movement of the circularly movable arm 16B in a direction of an arrow by a cam member 31 in a tray selecting means explained in detail below moves circularly the guide member 16 in the condition shown in FIG. 5A, so that the bottom edge of the guide member 16 is pulled down below the transport path 11. When the guide member 16 is not pulled down like this, but is supported in a position retracted from the transport path 11, the condition of the guide members 16 on trays 14 other than those in the No. 10 bin in FIG. 2 can be supported by a spring member not shown. Consequently, when the guide member 16 is pulled down, the circularly movable arm 16B moves circularly against the spring force of this spring member.

Next, an explanation will be made of the details of the transport portion 3 with reference to FIG. 6.

Figure 6:
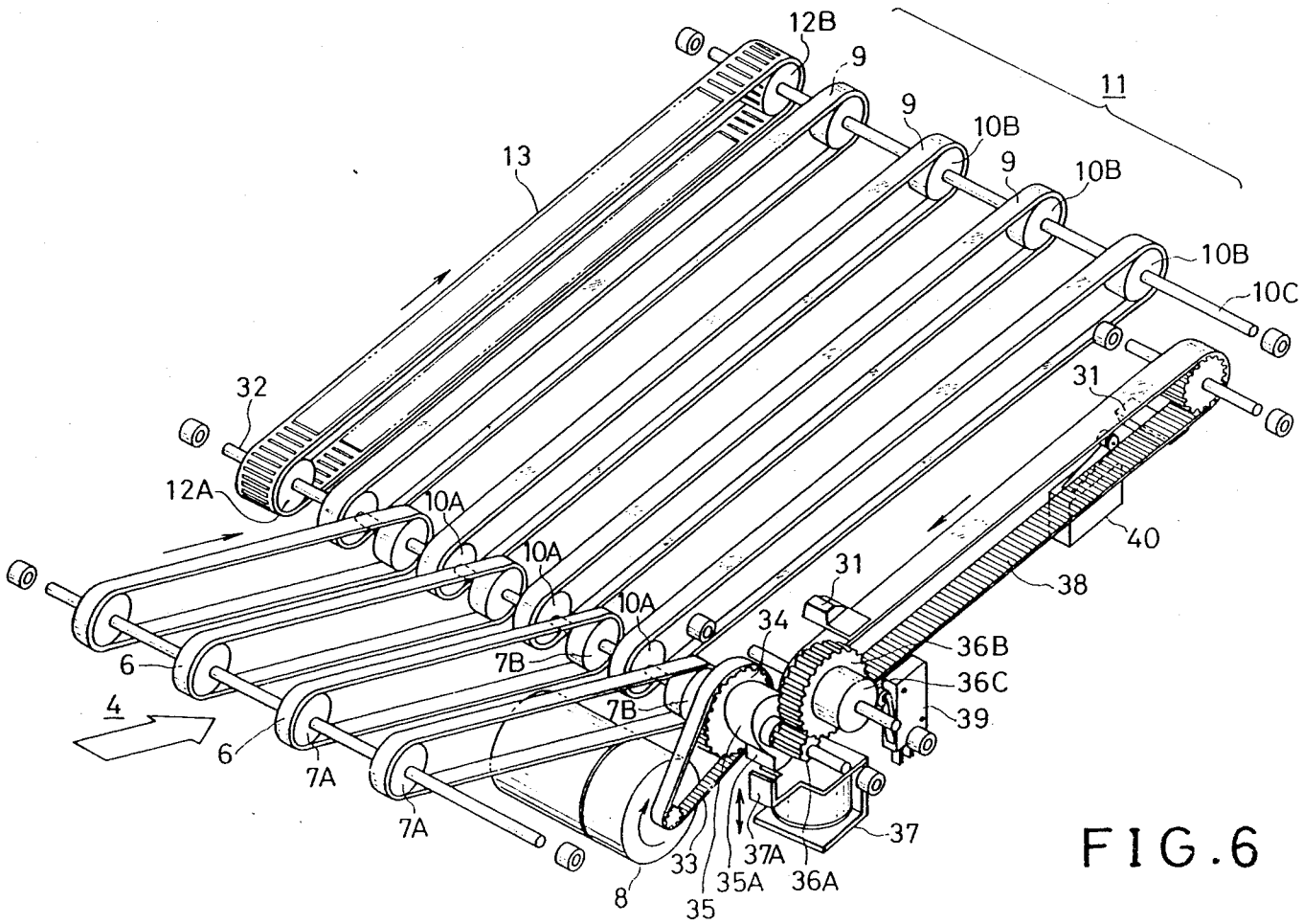
FIG. 6 is a perspective view showing a part of a feed and a transport portion and a tray selecting means with a motor displaced to facilitate understanding.

In FIG. 6, reference numeral 32 denotes a common drive shaft for driving a pulley, that is a feed-out roller 7B of a feed means, a feed-in roller 10A of a transport means and a sprocket 12A. A motor 8 rotates the common drive shaft 32 through a timing belt 33 and a drive gear 34, so that the recorded sheet inserted from the feed entry 4 can be transferred from the feed belt 6 to the transport belt 9 of the transport path. Furthermore, a one-way clutch cam 35 and a small gear 36A are disposed on this common shaft 32. A solenoid 37 having a lever 37A that can engage with the stopping surface 35A of the cam 35 is disposed underneath the cam 35.

Reference numeral 36B denotes a large gear that engages with the small gear 36A, reference numeral 36C a switch-action cam disposed on the same shaft as the large gear 36B and reference numeral 38 a timing belt that is driven in a direction of an arrow by a gear disposed in parallel with the large gear 36B. This timing belt 38 can move a cam member 31 for selecting a tray. Reference numeral 39 denotes a micro-switch which performs an off action due to the switch action cam 36C when the large gear 36B rotates once. Reference numeral 40 denotes a micro-switch for detecting a position of a No. 1 bin.

Figure 7:
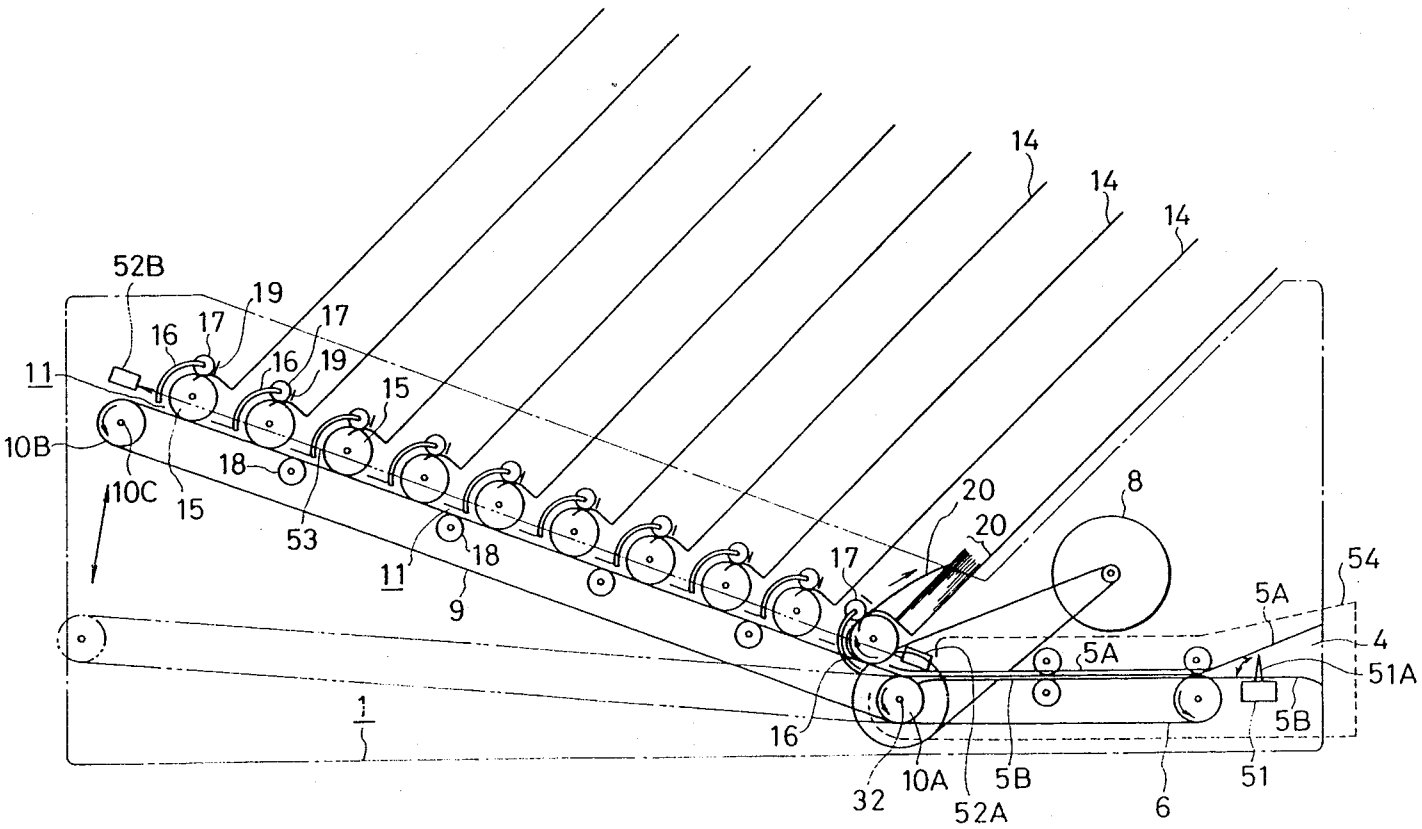
FIG. 7 is a schematic side view explaining a detection action of a recorded sheet detecting means disposed in a sorting apparatus according to the present invention and a recorded sheet discharge action.

Next, an explanation will be made of a sensor for monitoring operation up to when the recorded sheet is discharged to the tray 14 with reference to FIG. 7. In FIG. 7, reference numeral 51 denotes a first sensor for detecting the guiding of the recorded sheet to the feed opening and reference numeral 51A is the first sensor's activating lever that protrudes from the lower guide plate 5B toward the feed entry 4 side. That is, when the recorded sheet is inserted to the feed entry 4, the first sensor 51 detects that condition optically, for example, by the knocking over of the activating lever 51A, thereby starting the drive of the motor 8 so that the recorded sheet 20 is guided to the transport path 11 by the feed belt 6 and the transport belt 9.

Furthermore, in a case when the activating lever 51A of the first sensor 51 does not return to its original position even after passage of a predetermined time for the recorded sheet to be completely guided to the transport path 11, the control portion judges that a jam has occurred during guiding of the recorded sheet to the transport path 11, and can stop the motor 8.

Reference numerals 52A and 52B denote respectively a photo-transmitter and photo-receiver of a second sensor disposed respectively at an entry side and an exit side along the transport path 11. Reference numeral 53 denotes a light path between the photo-transmitter 52A and the photo-receiver 52B. Further, the relative positions on this light path 53 of the photo-transmitter 52A and the photo-receiver 52B are arranged so that, for instance, in the situation shown in FIG. 7, the recorded sheet 20 only blocks the light path 53 during the interval when the recorded sheet 20 is being guided to the tray 14 from the transport path 11 while being inverted by the guide member 16. Consequently, the light path 53 is not blocked when no recorded sheet 20 is on the transport path 11 or during a transport process in which a recorded sheet 20 on the transport path is not being inserted to a tray 14.

In this manner, the second sensor performs monitoring from when a recorded sheet starts to be discharged into one of the trays 14 until that discharging is completed. In a case that this time is longer than a predetermined interval, the control portion judges that a jam has occurred somewhere on the transport path 11 or in relation to the discharge roller 15 or the guide member 16 before the recorded sheet has been completely discharged into the tray 14, and can stop the motor 8.

Furthermore, when the second sensor detects that the recorded sheet 20 has been discharged into the tray 14, the control portion can activate the adjacent guide member so that the above-mentioned tray selecting means can discharge the recorded sheet 20 into the tray 14 on the next bin.

That is, when it is judged that the recorded sheet 20 is discharged into one of the trays 14, as shown in FIG. 6, the solenoid 37 energizes so that the lever 37A detaches from the stopping surface 35A of the cam 35 and the timing belt 38 is driven by the motor 8 through the one-way clutch cam 35 and the small gear 36A and the larger gear 36B that are reduction arrangements, thereby moving the selecting cam member 31 in a direction of an arrow. In this manner, the cam member 31 moves circularly the circularly movable arm 16B of the guide member 16 of the next tray 14 in a position corresponding to that next tray 14. When the guide member 16 is lowered to the condition shown in FIG. 5A, the micro-switch 39 de-energizes the solenoid 37, thereby engaging the lever 37A with the stopping surface 35A of the cam 35, stopping the timing belt 38 and adapting the condition for receiving the next recorded sheet.

Figure 8:
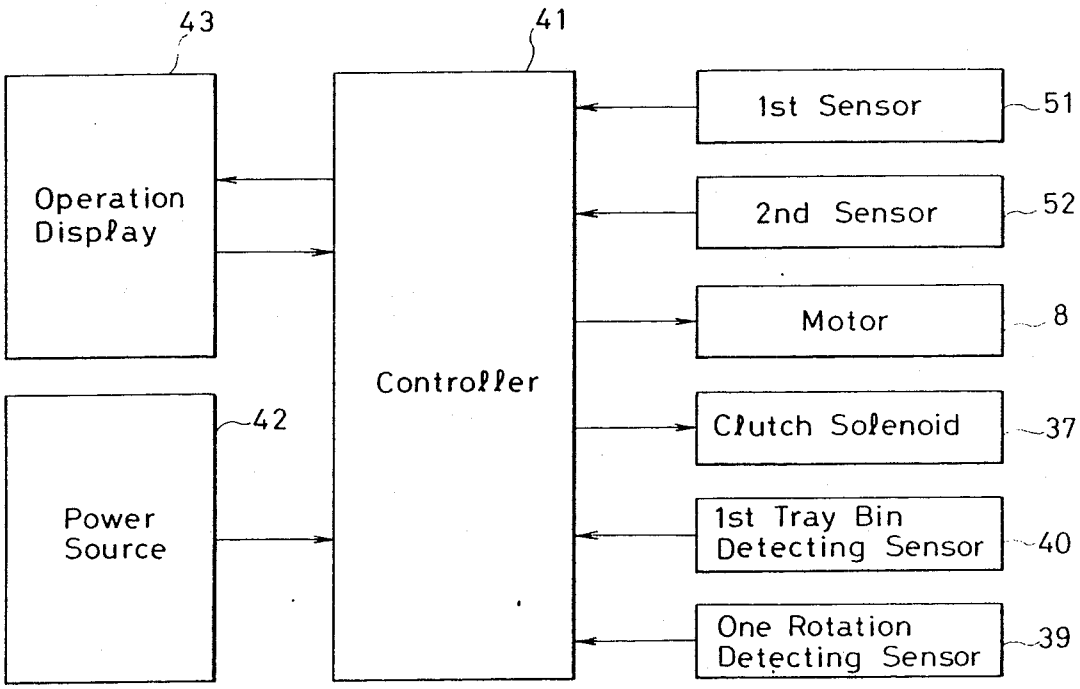
FIG. 8 is a block diagram showing a control circuit in a sorting apparatus according to the present invention.

FIG. 8 shows control block for performing the above actions. In FIG. 8, reference numeral 41 denotes a controller comprising a microprocessor, reference numeral 42 a power source, and reference numeral 43 an operating display. These elements are general-purpose items for this type of sorting apparatus and their explanation will be omitted.

Figure 9:
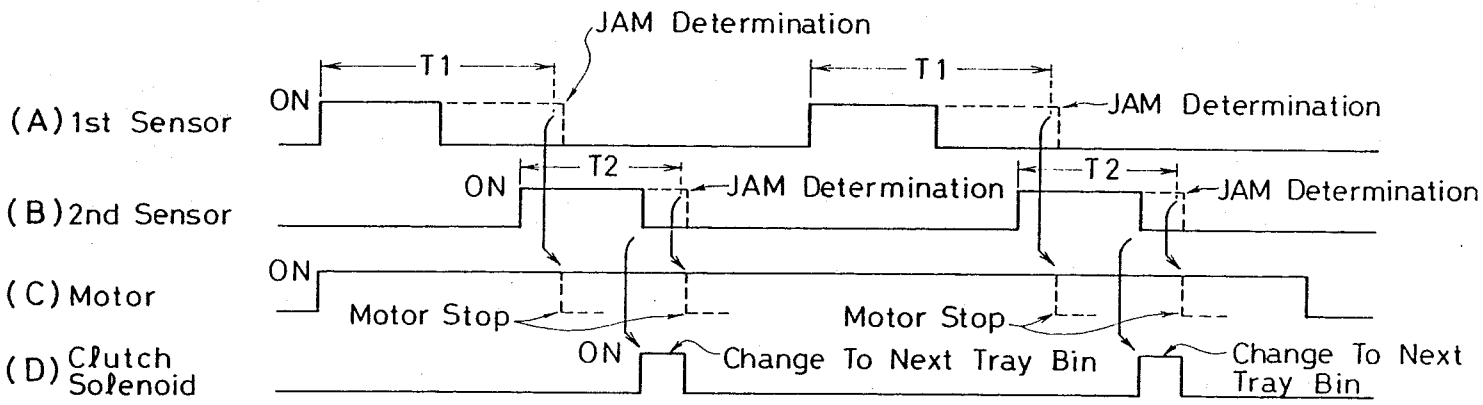
FIG. 9 is a timing chart for a sorting action by the above-mentioned sorting apparatus.

An explanation will now be made of a timing procedure for performing the above-mentioned series of actions by the controller with reference to FIG. 9. First, in (A) when the first sensor 51 detects a recorded sheet, it is turned "ON" and in (C) the motor 8 begins driving.

In this manner, if the recorded sheet is fed in the direction of the transport path 11, after a predetermined time T1 has passed, the controller judges that a jam has occurred and the motor in (C) stops.

Next, the recorded sheet is monitored by the second sensor 52 and when it begins to be inserted into the selected tray 14, the second sensor 52 in (B) turns "ON", then "OFF" when the insertion is completed. At this point the motor 8 maintains its driving condition as shown in (C). When the second sensor 52 turns "OFF", its falling edge causes the clutch solenoid 37 to turn "ON" as shown in (D). As explained above, the lever 37A then detaches from the stopping surface 35A, the cam member 31 disposed on the timing belt 38 advances and when the switching to the next tray bin is completed, the clutch solenoid 37 turns "OFF".

Further, in (B) if the second solenoid does not turn "OFF" even after the predetermined time T2 has passed, the controller judges that a jam has occurred and in (C) the drive of the motor 8 stops.

Thereafter, each time a recorded sheet is fed from the feed entry, the sorting action is performed according to the above-mentioned timing.

Because selection of the mode in the controller does not activate the tray selector, it is possible to discharge recorded sheets continuously to the same tray.

That is, all that is necessary to accomplish the above is for the controller 41 to be programmed so that an operating command on the operating display 43 prohibits the clutch solenoid 37 from turning "ON".

Furthermore, in FIG. 2, the portions forming the transport path 11, that is the transport portion 3 shown in FIG. 1, are arranged integrally with the pivotal support frame I so as to be freely circularly movable around the shaft center of the common drive shaft 32. In a case when a jam occurs, by releasing the stopping of the stopping portion disposed on the portion corresponding to the left side in FIGS. 2 and 7, the transport portion 3 can be easily pulled down to the position indicated by the dotted line in FIG. 2.

Because the transport path 11 can freely move circularly around this common drive shaft 32, moving the transport path 11 circularly until it is in a substantially horizontal attitude separated it from the tray support portion 2, thereby allowing for extremely easy operations during inspections or when removing a recorded sheet when a jam has occurred.

Further, the upper guide plate 5A and the lower guide plate 5B, the feeding mechanism 54 (enclosed by the broken line shown in FIG. 7) including the feeding means dependent on the feed belt 6, the shaft of the feed-in roller 7A and the shaft 32 of the feed-out roller 7B are supported by a frame III, and are arranged so as to be circularly movable around the common drive shaft 32 (refer to FIG. 2), thereby allowing for the height of the feed entry to be adjusted as desired.

Figure 10:
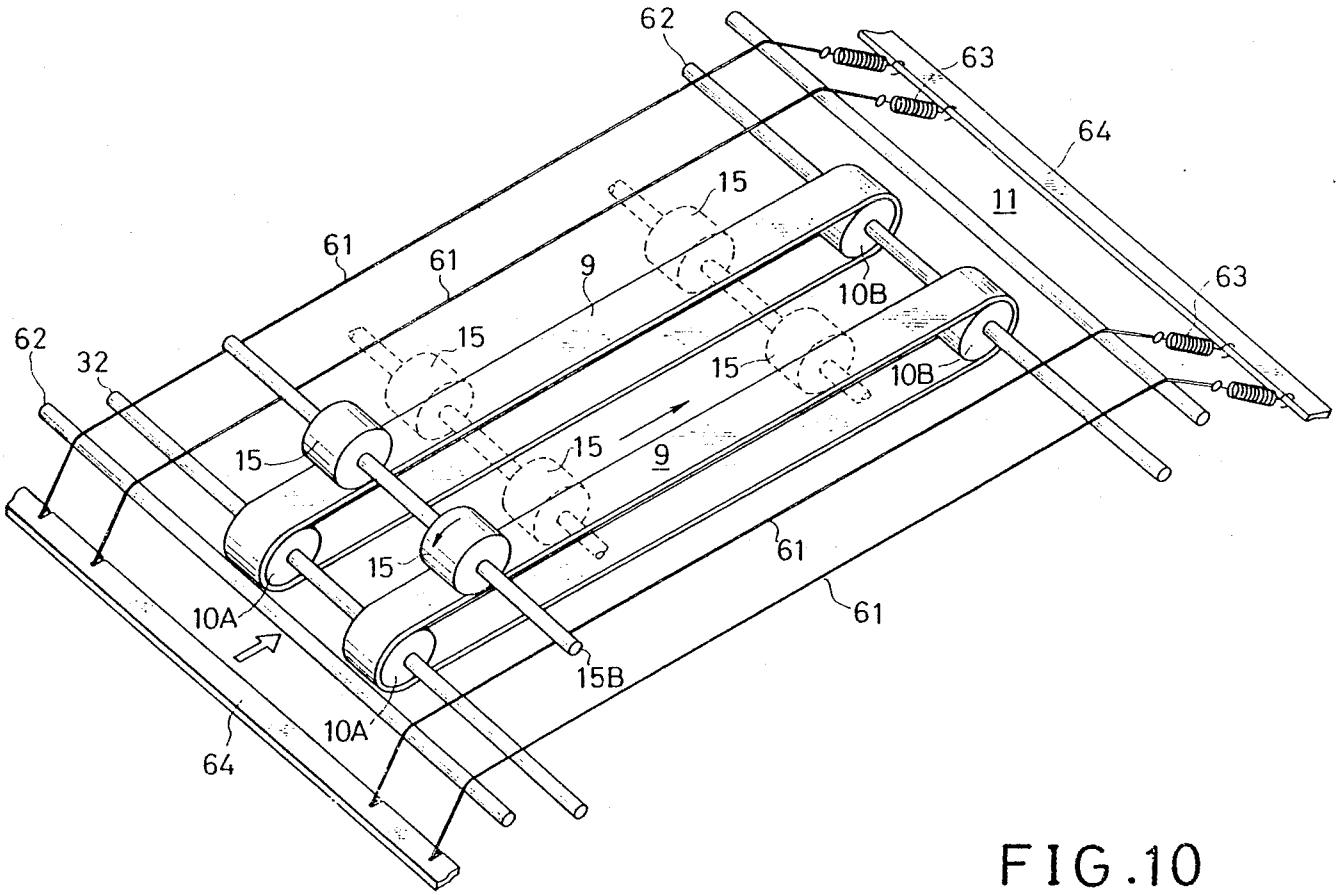
FIG. 10 is a perspective view showing a further embodiment of a transport portion in a sorting apparatus according to the present invention.

FIG. 10 shows an arrangement of a transport portion 3 in a further embodiment of the present invention, and contains parts which correspond to the transport path 11 in the arrangement shown in FIG. 6. In order to facilitate understanding, a part of the discharge roller 15 and the roller shaft 15B disposed on the tray side have been separated from the tray side and indicated with a dotted line. In the present embodiment, reference numeral 61 denotes a fine wire made from steel or plastic. In the embodiment shown in FIG. 6, the transport path 11 consisted of four transport belts 9 and their drive means, but in the present embodiment of the above-mentioned four transport belts 9, the belts 9 positioned on both sides and their drive means have been eliminated, being replaced respectively by two stretched fine wires 61 each.

Reference numeral 62 denotes a supporting rod that supports these fine wires 61 at a uniform height with the upper surface of the transport belts 9, and disposed so as to maintain the pitch between these fine wires 61 with accuracy. Reference numeral 63 denotes a coil spring for supporting a tensile force in the fine wires 61. In this manner, one edge of the coil spring 61 is fixed to a fixing frame 64 through the coil spring 62, and another edge is fixed directly to the fixing frame 64.

In the transport portion 3 arranged in this manner, when a recorded sheet is guided on to the transport path 11 by a feed belt not shown, it can be transferred by the transport belts 9 disposed in the center portion with its both edges supported in a flat condition by the plurality of fine wires 61. This reduction in the number of transport belts 9 alone contributes to a simplified construction and to lowering of costs.

What is claimed is:

1. A sorting apparatus comprising:

feeding means on a first frame including a first belt extended across a rotatable first feed-in roller and a rotatable first feed-out roller mounted on a common shaft, for feeding sheets introduced from a feed opening, said sheets being fed in a face-up mode in a feed direction;

transport means on a second frame downstream of said first frame in the feed direction, said transport means including a second belt extended across a rotatable second feed-in roller mounted on said common shaft and a rotatable second feed-out roller, and having a transport path for transporting said sheets in the feed direction, said transport path being formed on an upper surface of said second belt and having an incline rising in the feed direction of said sheets;

a plurality of trays disposed in parallel at equivalent intervals, each of said plurality of trays having a flange for housing sheets on its base edge, side walls on both sides of said base edge, and protrusions on said side walls;

tray support means on a third frame downstream from said first frame for supporting said base edge portion of said plurality of trays by engaging with said protrusions along said transport path and in a predetermined leaning attitude toward said transport path;

discharging means including a discharge roller supported on a tray shaft rotatably supported on said side walls, for discharging successively and selectively each of said sheets into one of said plurality of trays while inverting said sheet into a face-down mode, said discharge roller making contact with said second belt of said transporting means when each of said plurality of trays is supported by said tray supporting means; and said common shaft being rotatably supported on said third frame, said first and second frames being swingably pivoted about said common shaft, said common shaft being driven by a driving means.

2. A sorting apparatus as claimed in claim 1, further comprising a plurality of fine wires disposed on both sides of said second belt for forming a joint flat surface with the upper surface of said second belt.

3. A sorting apparatus as claimed in claim 1, wherein said discharge roller is driven by a sprocket disposed on an end of said tray shaft supporting said discharge roller.

4. A sorting apparatus as claimed in claim 3, wherein each of said common shaft supporting said first feed-out roller and said second feed-in roller and a support shaft supporting said second feed-out roller has a sprocket disposed on one of its ends, respectively, and a chain is extended across said sprockets.

5. A sorting apparatus as claimed in claim 4, wherein said sprocket of the discharge roller is driven by said chain extended across said sprockets disposed respectively on said common shaft of said first feed-out roller and said second feed-in roller and on said support shaft of said second feed-out roller.

6. A sorting apparatus as claimed in claim 5, wherein said support shaft of said second feed-out roller is supported on said second frame, so that an attitude of said transport path having an incline can be altered to a substantially horizontal position.

7. A sorting apparatus as claimed in claim 1, wherein said means for discharging successively and selectively said sheets comprises a guide member formed into an arc shape along said discharge roller and supported so as to be circularly movable around said tray shaft of said discharge roller and means for driving said guide member successively and selectively on each of said plurality of trays.

8. A sorting apparatus as claimed in claim 7, wherein said guide member has a rotatable pinch roller that contacts said discharge roller.

9. A sorting apparatus as claimed in claim 7, wherein said means for discharging successively and selectively said sheets comprises a timing belt associated with said transporting means and capable of moving in the feed direction of said sheets, a belt drive control means for advancing intermittently said timing belt in accordance with said intervals of said plurality of trays, and a cam member mounted on said timing belt, and a cam follow element disposed on said guide member.

10. A sorting apparatus as claimed in claim 9, wherein said belt drive control means has a clutch means for switching said timing belt between a stopped and a moving condition, and a solenoid for activating a switching action of said clutch means, and means for detecting the advance of said timing belt.

* * * * *